United States Patent [19]

Olgiati

[11] 4,441,089

[45] Apr. 3, 1984

[54] CHANGE-OVER SWITCH FOR COAXIAL CONDUCTORS

[75] Inventor: Gianni Olgiati, Nussbaumen, Switzerland

[73] Assignee: BBC Brown, Boveri & Company, Limited, Baden, Switzerland

[21] Appl. No.: 279,755

[22] Filed: Jul. 2, 1981

[30] Foreign Application Priority Data

Jul. 15, 1980 [CH] Switzerland ..... 5402/80

[51] Int. Cl.[3] ..... H01P 1/10

[52] U.S. Cl. ..... 333/105; 200/6 C; 200/153 S

[58] Field of Search ..... 333/105–107; 200/6 R, 6 C, 153 S

[56] References Cited

U.S. PATENT DOCUMENTS 3,215,954 11/1965 Stevens ..... 333/105

3,270,299 8/1966 Stapf ..... 200/153 S X

FOREIGN PATENT DOCUMENTS 1361488 7/1974 United Kingdom .

*Primary Examiner*—Paul L. Gensler

*Attorney, Agent, or Firm*—Oblon, Fisher, Spivak, McClelland & Maier

[57] ABSTRACT

The new change-over switch having a connecting element which is articulated to an inner conductor and which connects the connecting element selectively to one of two other conductors. The contacts between the connecting element and the one or the other inner conductors are designed as tulip-shaped contacts, thus permitting a hitherto unobtainable small loss factor and low reflection. During connecting-over, the switching element is pulled in the axial direction out of one tulip-shaped contact, pivoted and pushed into the other tulip-shaped contact. For this movement, the connecting element is designed as two-part telescopic tube. A crank is preferably used for pushing together, pivoting and re-extending the telescopic tube, as is necessary for switching-over.

5 Claims, 4 Drawing Figures

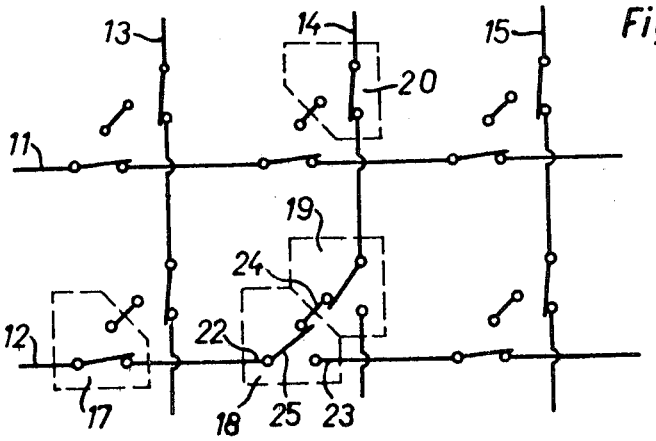
Fig. 1
Fig. 2
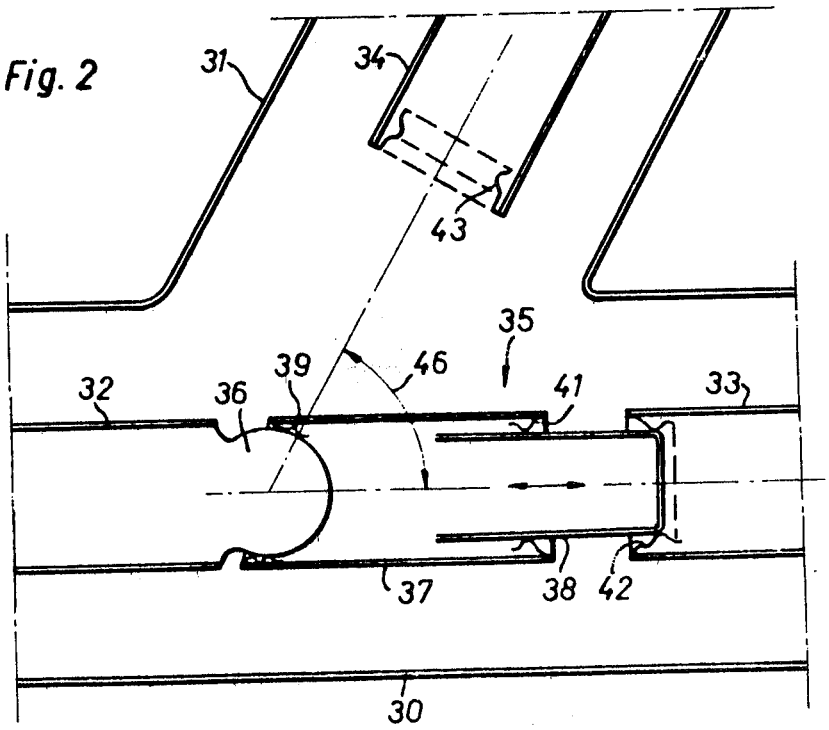

CHANGE-OVER SWITCH FOR COAXIAL CONDUCTORS

FIELD OF THE INVENTION

The present invention relates to a change-over switch for high-power coaxial conductors, with a branched outer conductor, the inner conductors of which end in the region of the branch, and with a connecting element, one end of which is articulated to one of the inner conductors and the other end of which can pivot between the ends of the other inner conductors, the electrical contact between the one inner conductor and the articulated end of the connecting element being designed as a tulip-shaped contact.

DESCRIPTION OF THE PRIOR ART

Change-over switches of the type described are used particularly in short-wave transmitting stations. Such transmitting stations usually have several transmitters and several antennae, the output and input lines of which are arranged crosswise and are connected to change-over switches to form a conductor matrix which permits the selective interconnection of each transmitter output with each antenna input.

A known change-over switch suitable for the use described contains a straight-line conductor strand and a branched conductor strand which is located between its ends and which forms an angle of 60° with the one strand end. The inner conductors are interrupted in the region of the branch. Articulated to the inner conductor in the conductor strand facing away from the branch is a connecting element, the free end of which can be attached either to the inner conductor in the branched conductor strand or to the inner conductor in the adjacent straight-line conductor strand. The end of the inner conductor to which the connecting element is articulated is designed as a ball joint, and the end of the connecting element interacting therewith has a tulip-shaped contact which consists of a plurality of contact springs distributed uniformly over the periphery of the connecting element. It is to be ensured, in this way, that the current paths are also distributed, in the region of the articulation of the inner conductor, symmetrically over its periphery and that the loss factor and the reflection in the region of this contact therefore remain low. The free end of the connecting element is connected via knife contacts to the adjacent end of the inner conductor, the contact faces lying in the pivoting plane of the connecting element.

Because of the pivoting movement of the connecting element during switching-over, it is not possible to distribute the contact faces of the knife contacts uniformly over the periphery of the connecting element or of the adjacent end of the inner conductor. The result of this is that in these contact regions the current paths have an uneven density, thus causing a high loss factor and high reflection and practically cancelling the advantages achieved with the tulip-shaped contact in the region of articulation.

SUMMARY OF THE INVENTION

The object on which the present invention is based is, therefore, to provide a change-over switch for coaxial conductors, which has, even at the contact faces between the pivotable end of the connecting element and the ends of the associated inner conductor, contacts with contact faces which are distributed uniformly over the periphery of the connecting element and of the respective adjacent inner conductor and which permit a uniform distribution of the current paths.

According to the invention, this object is achieved by means of a change-over switch of the type mentioned hereinabove, in which the contacts between the other inner conductors and the pivotable end of the connecting element are designed as tulip-shaped contacts and the connecting element for opening and closing these contacts is designed as an extendable telescopic tube.

The new change-over switch permits, by means of its tulip-shaped contact between the one inner conductor and the articulated part of the connecting element and the tulip-shaped contact between the pivotable end of the connecting element and the adjacent end of the inner conductor, a uniform distribution of the current paths in all the contact regions and, consequently, a hitherto unobtainable small loss factor and low reflection. The tulip-shaped contacts can be composed of a large number of individual contact springs, thus permitting low loading of the individual contact springs and, therefore, also a long service life and a large number of change-over operations.

In a preferred embodiment of the new change-over switch, the part of the connecting element articulated to the one inner conductor and the telescopically extendable part of this connecting element are connected to one another via a tulip-shaped contact.

In a further preferred embodiment of the new change-over switch, there is provided, for switching over the connecting element designed as a telescopic tube from one inner conductor to the other, a crank, the axis of rotation of which is perpendicular to the plane defined by the pivoting of the connecting element, and intersects this plane along the bisecting line of the angle of pviot, and the bent crank arm of which is connected movably to the displaceable part of the telescopic tube, in order, during switching-over, to isolate the tulip-shape contact on the one inner conductor, by pushing together the telescopic tube, to pivot the telescopic tube and to close the tulip-shaped contact on the other inner conductor by extending the telescopic tube.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

BRIEF DESCRIPTION OF THE DRAWINGS

FIG. 1 shows the diagram of part of a coaxial-conductor matrix with the change-over switches located in the region of intersection of the conductors, FIG. 2 shows a diagrammatically drawn section through one embodiment of the new change-over switch.

DESCRIPTION OF THE PREFERRED EMBODIMENTS

Figure 3:
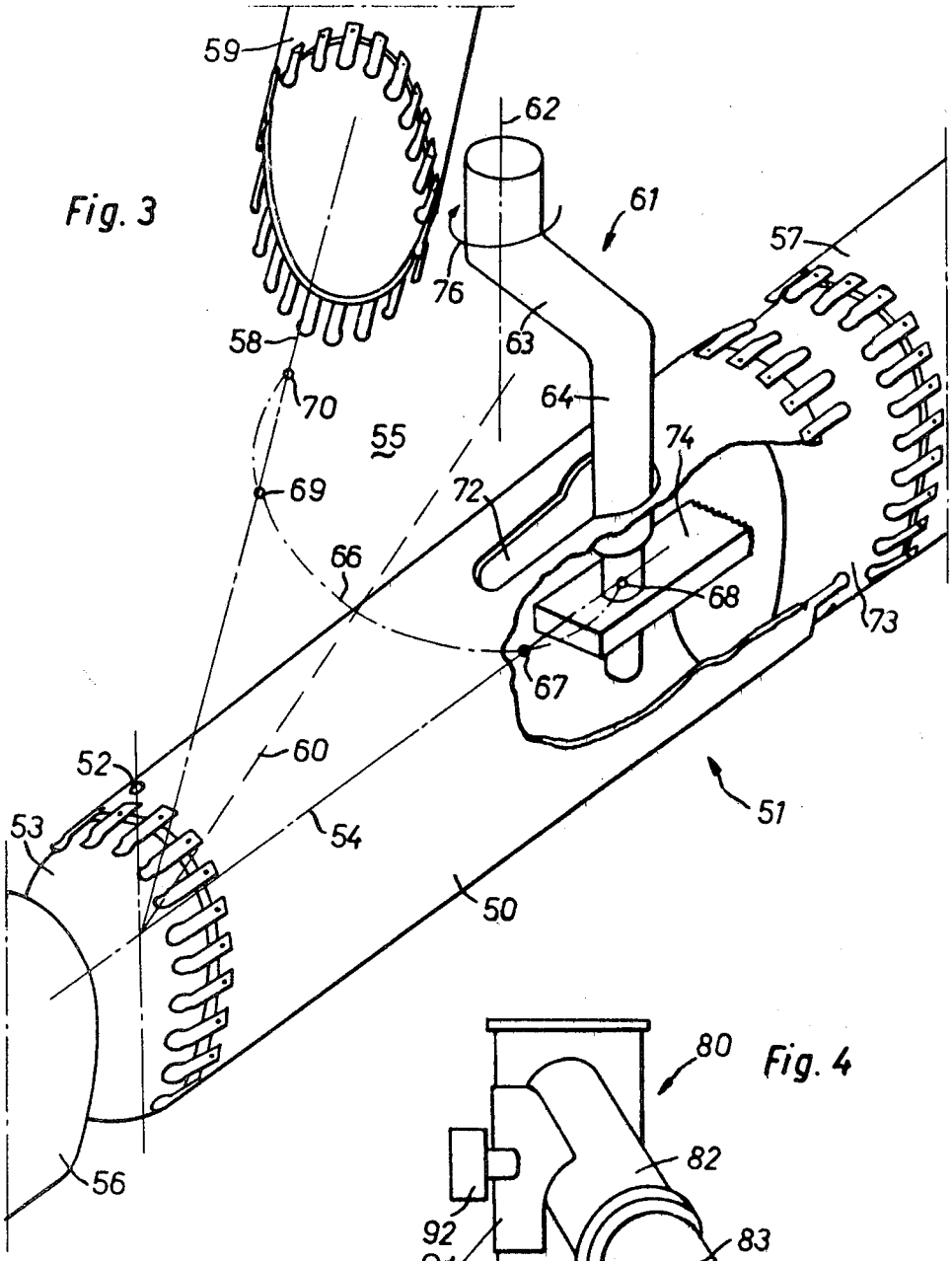
FIG. 3 shows a partially cut away perspective view of the inner conductors and of the connecting element of a preferred embodiment of the new change-over switch.

FIG. 1 shows two coaxial conductors 11, 12, each of which is connected to the output of a short-wave transmitter (not shown). Also shown are three coaxial conductors 13, 14, 15, which intersect the first-mentioned conductors 11, 12 and each of which leads to a transmitting antenna which is likewise not shown. Each conductor contains, in the region of the conductor intersection, a change-over switch, of which only the change-over switches 17, 18, 19, 20 are identified by reference numerals for the sake of a simpler illustration. Each change-over switch contains two ends of a straight-line conductor strand 22, 23 and a branched conductor strand 24 and a connecting element 25. In the example shown, the change-over switches 18, 19 are switched to the branched conductor strand 24, whilst all the other change-over switches connect the straight-line conductor strands. In this way, the transmitter linked to the coaxial conductor 12 is connected to the antenna linked to the coaxial conductor 14.

It is understood that, when two change-over switches are used in each intersection of the matrix, the two interacting change-over switches have to be switched over in the same direction if the conducting path is not to be interrupted.

FIG. 2 shows a diagrammatic section through one embodiment of the new change-over switch. The change-over switch contains a tubular straight-line outer conductor 30, from which is branched a likewise tubular outer conductor strand 31. The inner conductor of the straight-line outer conductor 30 is interrupted in the region of the branch and ends in the two inner conductors 32, 33. The inner conductor 34 of the branched outer conductor strand 31 also ends in the region of the branch. The end of the one inner conductor 32, which can be connected either to the inner conductor 33 extending in the same direction or to the branched inner conductor 34, is designed as a ball joint 36. To connect the one inner conductor 32 to one of the two other inner conductors 33, 34, a connecting element 35 is provided, with an outer tube 37 in which an inner tube 38 is arranged so as to be telescopically displaceable. Tulip-shaped contacts 39, 41, 42, 43 are located at the ends of the outer tube 37 interacting with the ball joint 36 and the inner tube 38 as well as at the ends of the two inner conductors 33, 34. Each of these tulip-shaped contacts 39, 41, 42, 43 consists of a plurality of contact springs which are arranged, spaced uniformly from one another, on the periphery of the respective tube ends or conductor end. The tulip-shaped contacts 39, 41, 42, 43 enable the adjacent tube or conductor parts to be mutually displaced or pivoted and guarantee a large contact face which is distributed uniformly over the conductor periphery. This also permits a uniform distribution of the current paths on the periphery of the conductors or tubes, as a result of which such contacts or high-frequency energy have only a very small loss factor and very low reflection.

When the conductive connection, shown in FIG. 2, between the inner conductors 32, 33 lying in the same direction is switched over to a conductive connection between the inner conductor 32 and the branched inner conductor 34, the connecting element 35 cannot simply be pivoted about the ball joint 36. Before the pivoting, the inner tube 38 has to be pulled back out of the tulip-shaped contact 42 into the outer tube 37 and, after the pivoting, moved out of the outer tube and into the tulip-shaped contact 43. The mechanism shown in FIG. 3 is provided for this cycle of movement. The outer tube 50 of the connecting element 51 is articulated to the ball joint 53 by means of a guide pin 52, as a result of which outer tube 50 can pivot only in a definite plane 55 which is defined by the longitudinal axis 54 of the two inner conductors 56, 57 lying in the same direction and by the prolongation of the axis 58 of the branched inner conductor 59. The two axes mentioned intersect at the centre point of the ball joint 53. Also provided is a crank 61, the axis of rotation 62 of which intersects the bisecting line 60 between the two axes 54, 58 and is perpendicular to the plane 55 defined by these axes. The length of the bend 63 of the crank is selected, in dependence on the distance of the axis of rotation 62 from the centre point of the joint ball 53, so that the crank arm 64 describes a circular path 66 which runs between the points 67, 68 near the longitudinal axis 54 of the two inner conductors lying in the same direction and between the points 69, 70 near the axis 58 of the branched inner conductor 59. The crank arm 64 engages through an orifice 72 into the inner space of the outer tube 50 and is there connected movably to a connecting rod 74 fastened to the inner tube 73. It is understood that the crank 61 is made of an electrically non-conductive material, for example high-frequency ceramic.

When the crank 61 is rotated out of the position shown in FIG. 3 in the direction of the arrow 76, the crank arm 64 pulls, between the points 68, 67, the connecting rod 74 and the inner tube 73 fastened thereto out of the tulip-shaped contact (not shown) of the inner conductor 57, then pivots the connecting element, between the points 67 and 69, in the direction of the axis 58 and, between the points 69 and 70, pushes the inner tube 73 into the tulip-shaped contact (not shown) on the branched inner conductor 59.

Figure 4:
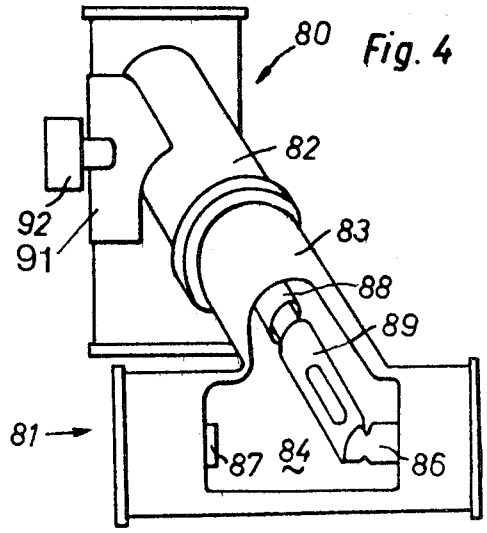
FIG. 4 shows a perspective view of two interacting change-over switches which are provided for insertion into an intersection of coaxial conductors in the matrix shown in FIG. 1.

FIG. 4 shows the perspective view of two change-over switches 80, 81, of which the branched outer conductors 82 and 83 respectively are flanged to one another. Two change-over switches connected in this way can be inserted into intersecting coaxial conductors, so as to connect these selectively to one another, as is shown, for example, in FIG. 1 for the coaxial conductors 12 and 14. The outer conductor of each change-over switch has, in the region of the branch, an orifice 84 which permits simple access to the inner conductors 86, 87, 88 and to the connecting element 89. The crank provided for switching over the connecting element 89 is mounted in the cover plate 91 for this orifice, and a motor 92 for driving the crank is located on the outer side of the plate 91. As already mentioned, the drive motors of the interacting change-over switches are excited preferably synchronously, in order to effect a switching movement of the change-over switches in the same direction.

In a tried embodiment of the new change-over switch for connecting the coaxial conductors of a 250 kW short-wave transmitter, an inner conductor with a diameter of approximately 6 cm was used. The tulip-shaped contacts each consisted of 70 beryllium bronze springs with a silvered contact face. The outer tube and inner tube of the connecting element were hard-gold-plated. After 54,000 change-over operations, practically no change in the electrical conduction properties of the change-over switch could be ascertained.

It is understood that the described embodiment of the new change-over switch can be adapted to special operating conditions and modified accordingly. For example, the change-over switch can have, instead of the branch described, also a conductor fork. It is also possible to design the displaceable part of the connecting element as an outer tube which has a tulip-shaped contact interacting with the inner tube and with the inner conductor. In this embodiment, the crank arm can be connected movably directly to the displaceable outer tube. If the tube of the connecting element is made of a suitable material, the end of the tube provided with a contact can be slitted in a simple way, and the tongues remaining between the slits can be used as the tulip-shaped contact. It is also possible to use, as a drive element, a pneumatic or hydraulic drive device or simply a crank handle, instead of the motor described.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A change-over switch for high-power coaxial conductors, comprising:

a branched outer conductor; a plurality of inner conductors which end in the region of the branch; a connecting element, one end of said connecting element being articulated to one said plurality of inner conductors and the other end of said connecting element pivoting between the ends of others of said plurality of inner conductors; a first electrical contact between the one of said plurality of inner conductors and the articulated end of said connecting element, said first electrical contact having the form of a tulip-shaped contact; second electrical contacts associated with said others of said plurality of inner conductors and the pivotable end of said connecting element, said second electrical contacts having the form of tulip-shaped contacts, and wherein said connecting element for opening and closing said second electrical contacts further comprises an extendable telescopic tube.

2. The change-over switch according to claim 1 wherein a part of the connecting element articulated to said one of said plurality of inner conductors and a telescopically extendable part of said connecting element are connected to one another via a third tulip-shaped contact.

3. The change-over switch according to claim 1 whereidn a crank is provided for switching over said connecting element in the form of said extendable telescopic tube from one of said others of said plurality of inner conductors alternately to another of said others of said plurality of inner conductors, said crank having an axis of rotation which is perpendicular to a plane defined by the pivoting of said connecting element, said axis of rotation intersecting said plane along the bisecting line of an angle of pivot of said connecting element, and said crank having a bent crank arm connected movably to a displaceable part of said telescopic tube such that during switching-over said second tulip-shaped contact on one of said others of said plurality of inner conductors is isolated by pushing together said telescopic tube, then pivoting said telescopic tube and closing said second tulip-shaped contact on another of said others of said plurality of inner conductors by extending said telescopic tube.

4. A switching matrix with at least two coaxial conductors arranged at right angles to one another, comprising:

a change-over switch associated with each said at least two coaxial conductors, each said change-over switch having a branched outer conductor and first, second and third inner conductors having terminating ends in the region of the branch and wherein said branched outer conductors of each said change-over switch are connected to one another and said second and said third inner conductors of each said change-over switch include an angle of 60° therebetween;

a connecting switch having a first end articulated to said terminated end of said first inner conductor and a second end pivotable between the terminated ends of said second and third inner conductors, said connecting switch further comprising an extendable telescopic tube capable of extension and retraction for alternately contacting said connecting switch to the terminated ends of said second and said third inner conductors;

a plurality of tulip-shaped contacts associated with said connecting switch, said second inner conductor and said third inner conductor such that said plurality of tulip-shaped contacts form electrical connections between said first end of said connecting switch and said terminated end of said first inner conductor and said second end of said connecting switch pivotable between said second inner conductor and said third inner conductor; and means for pivoting said connecting switch of each said change-over switch synchronously.

5. A switching matrix according to claim 4 wherein said at least two coaxial conductors are connected to at least one transmitter and at least one antenna of a short-wave transmitting station.

* * * * *